US011178481B2

(12) United States Patent
Oishi et al.

(10) Patent No.: US 11,178,481 B2
(45) **Date of Patent: *Nov. 16, 2021**

(54) EAR-PLUG ASSEMBLY FOR HEAR-THROUGH AUDIO SYSTEMS

(71) Applicant: Facebook Technologies, LLC, Menlo Park, CA (US)

(72) Inventors: Tetsuro Oishi, Bothell, WA (US); Morteza Khaleghimeybodi, Bothell, WA (US); Pablo Francisco Faundez Hoffmann, Kenmore, WA (US); Alan Ng, Redmond, WA (US); Antonio John Miller, Woodinville, WA (US); Gongqiang Yu, Redmond, WA (US); Chuming Zhao, Redmond, WA (US)

(73) Assignee: Facebook, Inc., Menlo Park, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/940,693

(22) Filed: Jul. 28, 2020

(65) Prior Publication Data

US 2021/0044891 A1 Feb. 11, 2021

Related U.S. Application Data

(63) Continuation of application No. 16/536,604, filed on Aug. 9, 2019, now Pat. No. 10,771,888.

(51) Int. Cl.
*H04R 1/10* (2006.01)
*H04R 3/04* (2006.01)
(Continued)

(52) U.S. Cl.
CPC ..... *H04R 1/1091* (2013.01); *H04R 1/04* (2013.01); *H04R 1/1016* (2013.01);
(Continued)

(58) Field of Classification Search
CPC ..... H04R 1/10; H04R 1/1016; H04R 1/1041; H04R 1/1083; H04R 1/1091;
(Continued)

(56) References Cited

U.S. PATENT DOCUMENTS

2003/0165246 A1 9/2003 Kvaloy et al.
2007/0147635 A1 6/2007 Dijkstra et al.
(Continued)

OTHER PUBLICATIONS

PCT International Search Report and Written Opinion, PCT Application No. PCT/US2020/043922, dated Oct. 6, 2020, 12 pages.

*Primary Examiner* — Mark Fischer
(74) *Attorney, Agent, or Firm* — Fenwick & West LLP

(57) ABSTRACT

An ear-plug assembly presents audio content to an ear canal of a user. The audio content may be based in part on sound in a local area surrounding the user. The ear-plug assembly detects, via one or more acoustic sensors, sound in the area around the user. The sound waves travel through an aperture in a body of the ear-plug assembly and are propagated to a waveguide to the one or more acoustic sensors. The ear-plug assembly processes the detected sound data in a controller, which instructs a speaker assembly to present audio content based in part on the detected sound data. The detected sounds may be amplified, attenuated, filtered, and/or augmented when presented by the speaker assembly.

20 Claims, 10 Drawing Sheets

(51) Int. Cl.
*H04R 1/34* (2006.01)
*H04R 1/04* (2006.01)

(52) U.S. Cl.
CPC ..... *H04R 1/1041* (2013.01); *H04R 1/342* (2013.01); *H04R 3/04* (2013.01)

(58) Field of Classification Search
CPC ..... H04R 2201/10; H04R 2201/107; H04R 2205/022; H04R 1/04; H04R 1/342; H04R 3/04
See application file for complete search history.

(56) References Cited

U.S. PATENT DOCUMENTS

| | | | | |
|---|---|---|---|---|
| 2008/0107287 | A1 | 5/2008 | Beard | |
| 2013/0218022 | A1 | 8/2013 | Larsen et al. | |
| 2013/0343564 | A1 | 12/2013 | Darlington | |
| 2015/0023510 | A1* | 1/2015 | Shimizu ..... | H04R 29/001 381/58 |
| 2018/0255394 | A1 | 9/2018 | Colich | |

* cited by examiner

EAR-PLUG ASSEMBLY FOR HEAR-THROUGH AUDIO SYSTEMS

CROSS REFERENCE TO RELATED APPLICATIONS

This application is a continuation of co-pending U.S. application Ser. No. 16/536,604, filed Aug. 9, 2019, which is incorporated by reference in its entirety.

BACKGROUND

The present disclosure generally relates to an audio system in a headset, and specifically relates to ear-plug assemblies in hear-through audio systems.

Headsets often include features such as audio systems to provide audio content to users of the headsets. Conventionally, a user of the headset wears headphones to receive, or otherwise experience, computer generated sounds. However, wearing headphones suppresses sound from the real-world environment, which may expose the user to unexpected danger and also unintentionally isolate the user from the environment.

SUMMARY

An ear-plug assembly is an in-ear device configured to present a user with improved audio content. The ear-plug assembly is configured to at least partially fit inside a user's ear canal. The ear-plug assembly includes a body, one or more apertures, one or more acoustic sensors, and a speaker. At least one of the one or more apertures is located at or substantially proximate to an entrance to the ear canal while the user is wearing the ear-plug assembly. The location of the aperture at or substantially proximate to the entrance of the ear canal helps preserve spatial cues. The one or more apertures are entrances to one or more acoustic waveguides that guides sound from a local area around the user to the one or more acoustic sensors located within the body. The one or more acoustic sensors detect the sound. The one or more speakers are coupled to a portion of the body, and present audio content within the ear canal of the user, based on the detected sounds.

In some embodiments, a method for presenting adjusted audio content via the ear-plug assembly is disclosed. The method includes detecting sounds from the area surrounding the user via the ear-plug assembly, generating sound filters using the sounds detected from the local area, and presenting adjusted audio content based in part on the sound filters, via the ear-plug assembly, to a user's ear canal.

Figure 1:
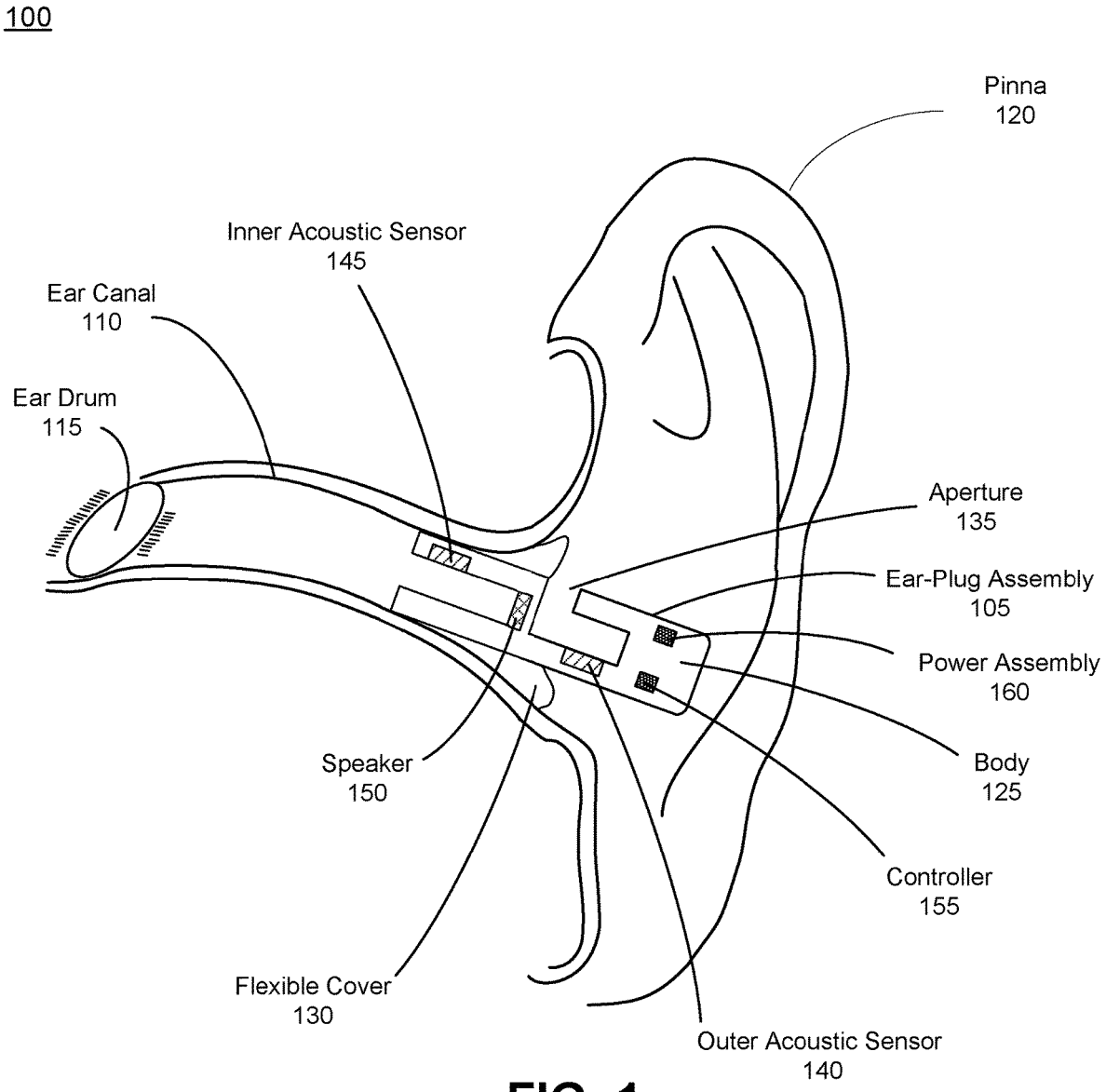
FIG. 1 is a cross-sectional view of an ear-plug assembly within a user's ear canal, in accordance with one or more embodiments.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

An ear-plug assembly presents audio content to a user, by functioning as a hear-through audio system. The ear-plug assembly detects sound from a local area surrounding the user and rebroadcasts them to the user.

The ear-plug assembly comprises a number of components that may be coupled to a body. In addition to the body, the ear-plug assembly comprises one or more acoustic sensors, speakers, and waveguides, among other components. The ear-plug assembly also includes a controller and a power assembly. The ear-plug assembly is configured to at least partially fit inside an ear canal of the user. The body is configured to have an aperture that is located adjacent to or close to the user's ear canal and unobstructed, such that sounds from the local area pass through the aperture into an acoustic waveguide. The acoustic waveguide guides the sound to the acoustic sensor within the body, which detects the sounds from the local area. The sound is processed by a controller, which instructs the speaker to broadcast audio content to the user's ear canal. The audio content may be based in part on the sounds detected from the local area. In some embodiments, the controller may instruct the speaker to present filtered and/or augmented audio content to the ear canal.

The ear-plug assembly functions as an audio system that preserves monoaural and binaural spatial cues. The ear-plug assembly preserves spatial cues by way of a ported acoustic sensor, positioned in proximity to the user's ear canal. Note that noise scales inversely with size for a microphone. The ear-plug assembly also includes sufficient space for a larger acoustic sensor than those in conventional hear-through systems, such that less noise is generated and perceived by the user. As opposed to conventional hear-through systems, in some embodiments, the ear-plug assembly also includes one or more inner acoustic sensors, positioned within a portion of the body that is close to the user's ear canal. The small form factor of the ear-plug assembly increases the bandwidth of monoaural and binaural spatial cues preserved for the user. Sounds from the local area may be amplified, attenuated, augmented, and/or filtered when rebroadcast to the user.

Embodiments of the invention may include or be implemented in conjunction with an artificial reality system.

Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset (e.g., head-mounted display (HMD) and/or near-eye display (NED)) connected to a host computer system, a standalone headset, a mobile device or computing system, or any other hardware platform capable of providing artificial reality content to one or more viewers.

System Overview

FIG. 1 is a cross-sectional view 100 of an ear-plug assembly 105 within a user's ear canal 110, in accordance with one or more embodiments. The ear-plug assembly 105 detects sound from a local area around a user and presents audio content, based in part on the sound from the local area, to the user. The cross-sectional view 100 includes components of an ear of the user, including, an ear canal 110, an ear drum 115, and a pinna 120. The ear-plug assembly 105 includes a body 125, a flexible cover 130, an aperture 135, an outer acoustic sensor 140, a speaker 150, a controller 155, and a power assembly 160. In some embodiments, the ear-plug assembly 105 includes an inner acoustic sensor 145. A portion of the ear-plug assembly 105 fits within the ear canal 110 of the user's ear, such that the speaker 150 is able to present audio content within the ear canal 110, to the ear drum 115.

The body 125 couples to a number of other components of the ear-plug assembly. The body 125 is configured to at least partially fit within the ear canal 110, and couples to the outer acoustic sensor 140, the speaker 150, and in some embodiments, the inner acoustic sensor 145. At least a portion of the body 125 fits within the ear canal 110 of the user's ear, while the remaining portion of the body 125 is unoccluded. In some embodiments, the portion of the body 125 that fits within the ear canal 110 of the user's ear may be shaped like a nozzle. The nozzle improves the quality of sound presented to the user, particularly for high frequency sounds. The nozzle may also couple to and allow customization of the flexible cover 130 to better fit the user's ear. The body 125 may be formed of one or more materials that attenuate sound, ensuring that the user is able to better hear the audio content produced by the speaker. For example, the body 125 may be composed of foam, silicone, plastic, rubber, or some combination thereof. The body 125 may be rotationally symmetric around a central axis. In FIG. 1, the body 125 is substantially cylindrical with rounded ends, but in other embodiments, the body may be of other geometries.

The body 125 may be partially enclosed by the flexible cover 130. The flexible cover 130 prevents the leakage of audio content presented by the speaker 150 within the ear canal 110. The flexible cover 130 seals the portion of the body 125 that fits within the ear canal 110, fitting to the shape of the ear canal. The flexible cover 130 may be composed of some sound insulating material, such as foam, silicone, or some combination thereof. The flexible cover 130 may have a form resembling a generic ear-plug. In some embodiments, the flexible cover 130 may be customized for the shape of the user's ear canal, thereby enhancing the attenuation of unwanted sounds, such as external loud noises. A customized flexible cover 130 may improve the fit and stability of the ear-plug assembly within the user's ear. In some embodiments, a portion of the flexible cover 130 may be composed of metal, such as aluminum, steel, or some combination thereof. A heavier flexible cover 130 results in improved attenuation of unwanted sounds by reducing background noise and increasing the signal to noise ratio delivered to the eardrum 115 of the user's ear. Accordingly, a heavier flexible cover 130 improves the quality of sound presented to the user, delivering a more convincing hear-through experience.

The aperture 135 is an entrance to an acoustic waveguide within the body. The acoustic waveguide (not pictured in FIG. 1) guides sound from the local area to the outer acoustic sensor 140. The aperture 135 is positioned proximate to the entrance of the ear canal, wherein at least a portion of the aperture 135 is unobstructed. For example, the aperture 135 may be positioned in the unoccluded portion of the body 125, such that it is between the outer acoustic sensor 140 and the entrance of the ear canal, as indicated by the aperture 135. The aperture 135 is located on a surface of the body 125. The aperture 135 has a first side and a second side on the surface of the body 125, such the first side is at least 280 degrees apart from the second side relative to the central axis of the body 125. In some embodiments, the body 125 may include a plurality of apertures, similar to the aperture 135, each serving as additional entrances to at least one acoustic waveguide.

The outer acoustic sensor 140 monitors and detects the sound from the local area. The outer acoustic sensor 140 is positioned within the unoccluded portion of the body 125 of the ear-plug assembly, proximate to the aperture 135. Accordingly, sound from the local area passes through the aperture 135 and propagates through the acoustic waveguide to the outer acoustic sensor 140. The outer acoustic sensor 140 may include, for example, a microphone, accelerometer, other acoustic sensors, or some combination thereof. In some embodiments, the body 125 includes a plurality of acoustic sensors, at least one of which may be placed on a surface of the body 125. The outer acoustic sensor 140 may be a microphone, an accelerometer, or another sensor that detects the acoustic pressure waves. The outer acoustic sensor 140 may transmit the acoustic data it detects to the controller 155 of the ear-plug assembly 105.

In some embodiments, the body 125 includes the inner acoustic sensor 145, which detects sound from the local area and sound transmitted via tissue conduction. For example, in addition to the ear-plug assembly 105, the user may be wearing a headset with an audio system that provides audio content via tissue conduction. Accordingly, the inner acoustic sensor 145 may detect acoustic content generated by vibrations to tissue near a cranial bone of the user. The inner acoustic sensor 145 may also detect the user's own voice. The user's own voice may be amplified due to occlusion of the ear canal 110 by the ear-plug assembly 105. The inner acoustic sensor 145 may be a microphone, an accelerometer, or another sensor that detects the acoustic pressure waves In addition to the outer acoustic sensor 140 and the inner acoustic sensor 145, the ear-plug assembly 105 may include a plurality of sensors designated for use other than measuring audio data and/or a plurality of acoustic sensors substantially similar to the outer acoustic sensor 140 and the inner acoustic sensor 145 described herein. For example, other sensors within the ear-plug assembly 105 may include initial measurement units (IMUs), gyroscopes, position sensors, or a combination thereof.

The speaker 150 presents audio content within the ear canal 110 of the user, as per instructions received by the controller 155. The speaker 150 may present audio content based in part on the sound from the local area around the user, detected by the outer acoustic sensor 140. In some embodiments, the speaker 150 may present audio content based in part on the sound detected by the inner acoustic sensor 145, i.e., sounds transmitted via tissue conduction. In some embodiments, the controller 155 may instruct the speaker 150 to amplify, attenuate, augment, and/or filter the sound detected from the local area of the user. For example, the speaker 150 may present augmented audio content to the user for use in a VR and AR headset. The speaker 150 presents audio content within the ear canal 110 such that the sound vibrates the eardrum 115 and passes through a middle ear ossicular chain of the user's ear to a cochlea of the user's inner ear. The cochlea of the user perceives the vibrations as audio content. The speaker 150 may present the audio content via air conduction. With air conduction, the speaker 150 creates airborne acoustic pressure waves and sends them to the eardrum of the user, which vibrates and is detected by the cochlea of the user. Tissue conduction involves vibrating tissue in and/or near the ear of the user, such as bone or cartilage, generating tissue borne acoustic pressure waves detected by the cochlea.

The speaker 150 is located within the body 125, proximate to the ear drum 115 of the user's ear. The speaker 150 may be coupled to a portion of the body 125. Coupling may be such that there is indirect and/or direct contact between the speaker 150 and the body 125. In some embodiments, the speaker is positioned on a surface of the body 125 of the ear-plug assembly.

The controller 155 receives and processes sound data detected by acoustic sensors within the ear-plug assembly 105, such as the outer acoustic sensor 140 and the inner acoustic sensor 145. The controller 155 may be positioned within the body 125, such as within the portion of the body 125 configured to fit within the ear canal 110 of the user. The power assembly 160 may power the sensors and speaker in the ear-plug assembly 105, via a battery, for example. The ear-plug assembly may include other electronic components (not shown in FIG. 1).

The controller 155 may instruct the speaker 150 to present audio content based in part on the sound from the local area detected by the outer acoustic sensor 140 and sound transmitted via tissue conduction, detected by the inner acoustic sensor 145. For example, the controller 155 may amplify the sound from the local area, resulting in the speaker 150 presenting louder sound from the local area within the ear canal of the user. In another embodiment, the controller 155 may instruct the speaker 150 to present sound from the local area from a large bandwidth, resulting in an increase in the range of frequencies the user is able to hear. For use in artificial reality applications, the controller 155 may include sound filters to augment the sound detected from the local area. For example, the sound filters may be used to spatialize sound such that it appears to originate from a virtual object being presented to the user while also rebroadcasting sound from a local area of the user. The controller 155 may also attenuate sound detected by the inner acoustic sensor 145. For example, the inner acoustic sensor 145 may detect sounds of the user's voice getting amplified, when the acoustic pressure waves from their speech get transmitted through tissue and/or bone of the user. The user's voice may get amplified due to the ear-plug assembly 105 occluding the user's ear canal 110. The controller 155 subsequently may instruct the speaker 150 to attenuate the sounds of the user's own voice when presenting audio content. Accordingly, the user may perceive their own voice with more clarity and more naturally, while also perceiving the presented audio content. In another embodiment, the controller 155 may amplify and/or attenuate sounds detected from the local area that fall within a range of frequencies. For example, in a noisy environment near a train station, the speaker 150 may attenuate high frequency train whistles when presenting audio content to the user's ear canal.

The power assembly 160 provides power to the ear-plug assembly 105. The power may be used to power the controller 155, the outer acoustic sensor 140, the inner acoustic sensor 145, and the speaker 150 in the ear-plug assembly 105. The power assembly 160 may be a battery, for example. In some embodiments, there are one or more power assemblies 165 for some or all of the components of the ear-plug assembly 105. In some cases, the power assembly 160 is a rechargeable battery.

Figure 2A:
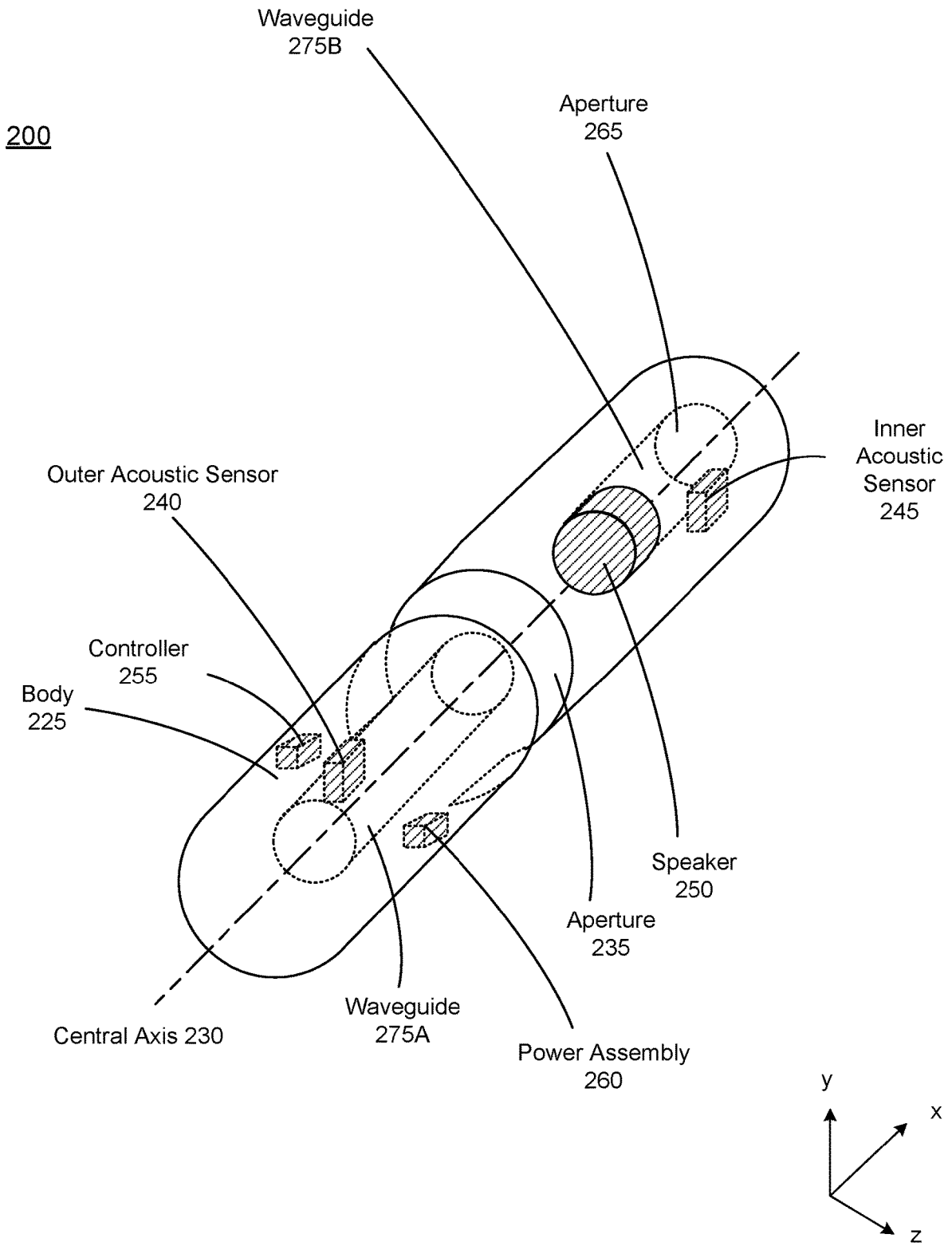
FIG. 2A is a perspective view of an ear-plug assembly, in accordance with one or more embodiments.

FIG. 2A is a perspective view 200 of the ear-plug assembly 105, in accordance with one or more embodiments. The perspective view 200 shows the components of the ear-plug assembly 105 depicted in FIG. 1, such that the body 225 corresponds to the body 125, the aperture 235 to the aperture 135, the outer acoustic sensor 240 to the outer acoustic sensor 140, the speaker 250 to the speaker 150, the inner acoustic sensor 245 to the inner acoustic sensor 145, the controller 255 to the controller 155, and the power assembly 260 to the power assembly 160. FIG. 2 also shows, coupled to the body 225, a waveguide 275A, a waveguide 275B, and an aperture 265. The body 225 is rotationally symmetric around a central axis 230. Note that the flexible cover 130 has been omitted from the figure for simplicity.

The waveguides 275A, 275B guide sound waves to a region within the body 225 of the ear-plug assembly 200. The waveguide 275A may be positioned adjacent to and/or proximate to the aperture 235, such that acoustic pressure waves entering the aperture 235 are guided to the outer acoustic sensor 240. The acoustic pressure waves entering the aperture 235 may be from the local area surrounding the user.

The waveguide 275B may guide sound waves produced by the speaker 220 to the aperture 265, such that the sound produced by the speaker 220 is presented to the ear canal (e.g., the ear canal 110) of the user. The waveguide 275B may also guide sound waves transmitted via tissue conduction to the inner acoustic sensor 245. For example, an additional waveguide may be proximate to the aperture 265 and propagate sound to the inner acoustic sensor 245. The waveguides 275A, 275B may each be a tube, channel, or some combination thereof.

The aperture 265 allows sound waves passing through the waveguide 275B to exit into the ear canal of the user. The aperture 265 is within a portion of the body 225 that fits within the ear canal of the user. The aperture 265 may be substantially similar in geometry to the aperture 235.

Figure 2B:
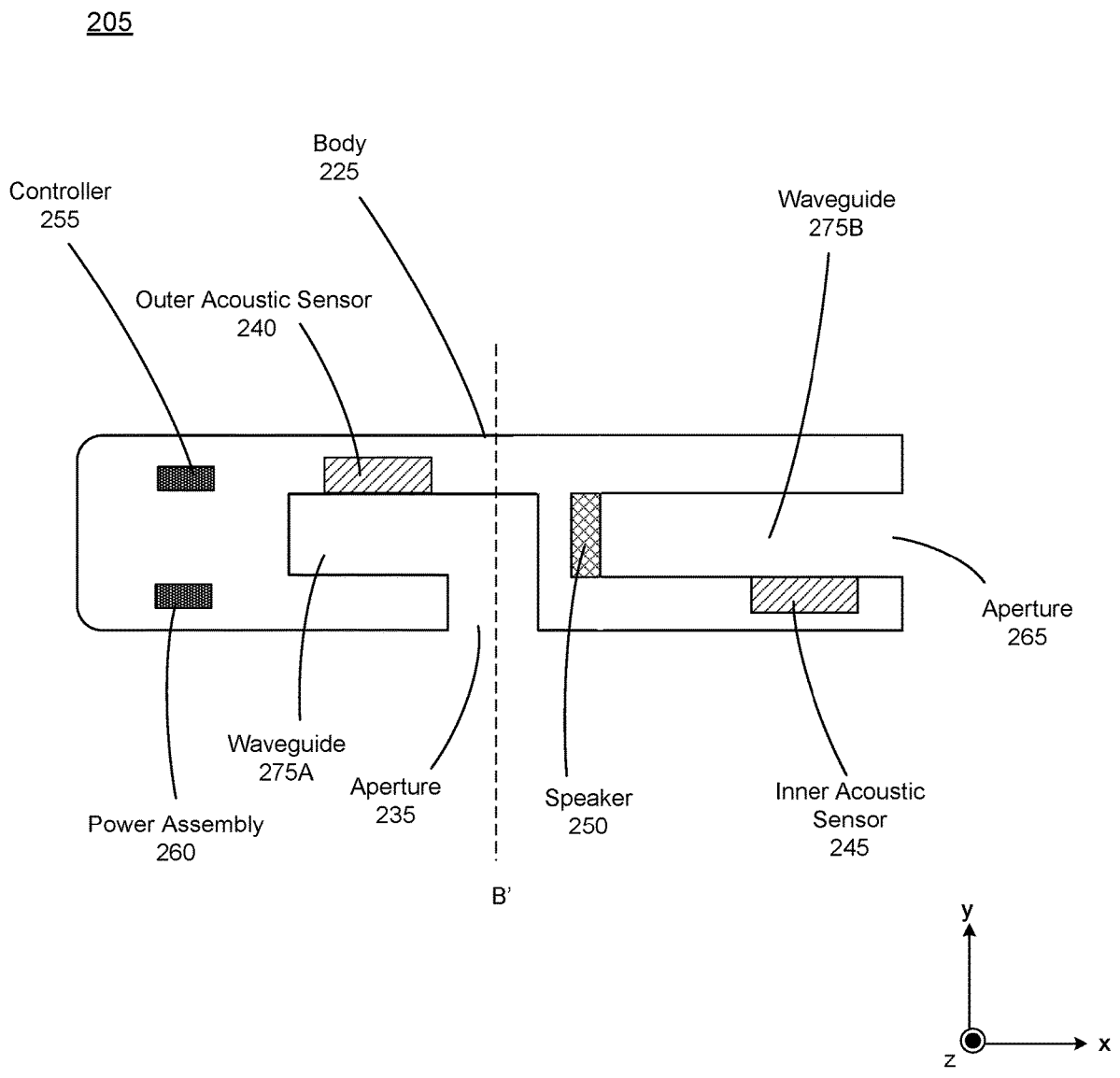
FIG. 2B is a cross-sectional side view of the ear-plug assembly of FIG. 2A, in accordance with one or more embodiments.

FIG. 2B is a cross-sectional side view 205 of the ear-plug assembly 105, in accordance with one or more embodiments. A line B' indicates the position from which FIG. 2C is presented.

Figure 2C:
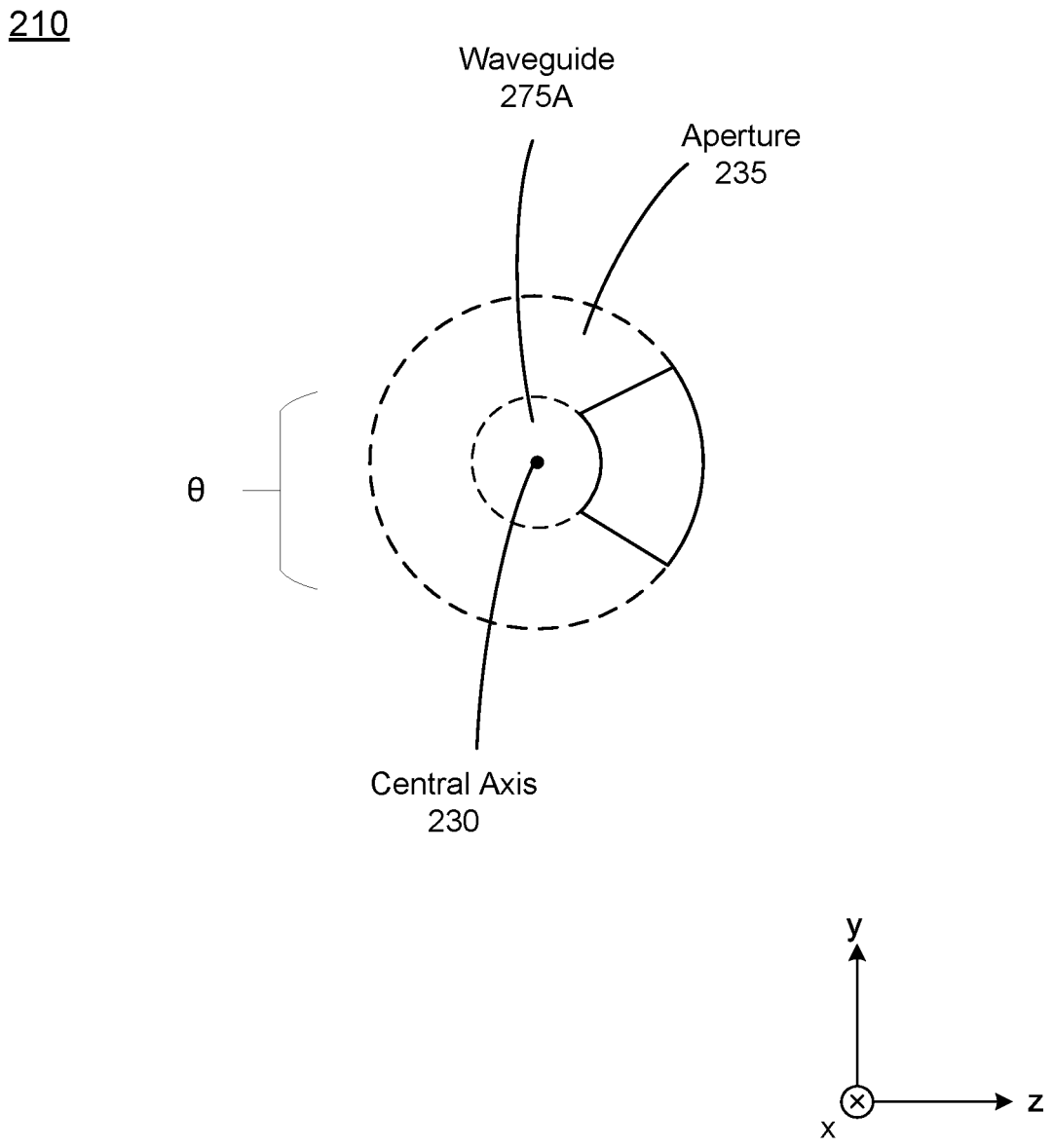
FIG. 2C is a top down cross-sectional view of the ear-plug assembly of FIG. 2A, in accordance with one or more embodiments.

FIG. 2C is a top down cross-sectional view 210 of the ear-plug assembly 105, in accordance with one or more embodiments. The top down cross-sectional view 210 shows the ear-plug assembly 105 from the line B' in FIG. 2B. FIG. 2C shows the aperture 235 and the waveguide 275A. The aperture 235 spans an angle θ, between a first side and a second side, relative to the central axis 230. In some embodiments, the angle θ may be at least 280 degrees.

Figure 2D:
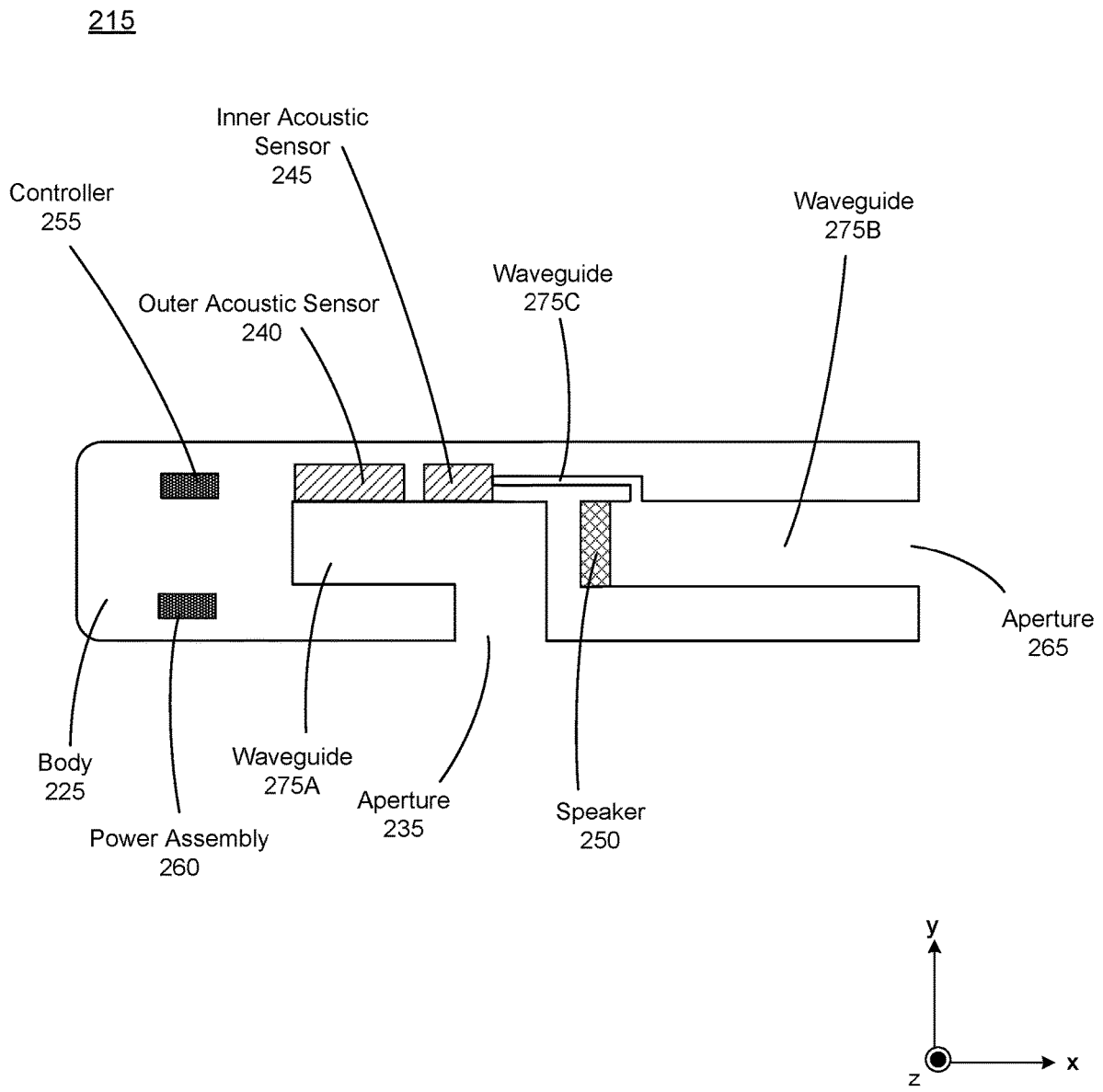
FIG. 2D is a cross-sectional side view of another embodiment of an ear-plug assembly with an inner acoustic sensor positioned adjacent to an outer acoustic sensor, in accordance with one or more embodiments.

FIG. 2D is a cross-sectional side view 215 of another embodiment of an ear-plug assembly with an inner acoustic sensor positioned adjacent to an outer acoustic sensor, in accordance with one or more embodiments. The ear-plug assembly in FIG. 2D is substantially similar to the ear-plug assembly shown in FIG. 2B, except that the ear-plug assembly in FIG. 2D includes the inner acoustic sensor 245 coupled to an additional waveguide 275C. In FIG. 2C, the inner acoustic sensor 245 is positioned in a portion of the body 225 that is positioned outside the ear canal of the user. In some embodiments, the inner acoustic sensor 245 may be adjacent to the outer acoustic sensor 240. The inner acoustic sensor 245 may couple to an additional waveguide 275C. The positioning of the inner acoustic sensor 245 enables a smaller sized portion of the ear-plug assembly 105 to fit into the ear canal of the user. Accordingly, user comfort may be enhanced while preserving spatial cues from the local area around the user. The additional waveguide 275C may be substantially similar to the waveguides 275A, 275B. The additional waveguide 275C guides sound waves generated by vibrations to tissue near a cranial bone of the user and/or the user's voice to the inner acoustic sensor 245. In some embodiments, the additional waveguide 275C may be separate from and/or not coupled to the waveguide 275B. Sound may enter through an aperture of the body 225 separate from the aperture 265, to travel through the additional waveguide 275C and reach the inner acoustic sensor 245. In some embodiments, the additional waveguide 275C may reverberate, causing nulls in the sound waves detected by the inner acoustic sensor 245. A mesh may be located in front of the inner acoustic sensor 245 to smooth out nulls detected by the inner acoustic sensor 245. In some embodiments, the mesh may be coupled to the inner acoustic sensor 245, while in other embodiments, the mesh may be located some distance away from the inner acoustic sensor 245.

Figure 2E:
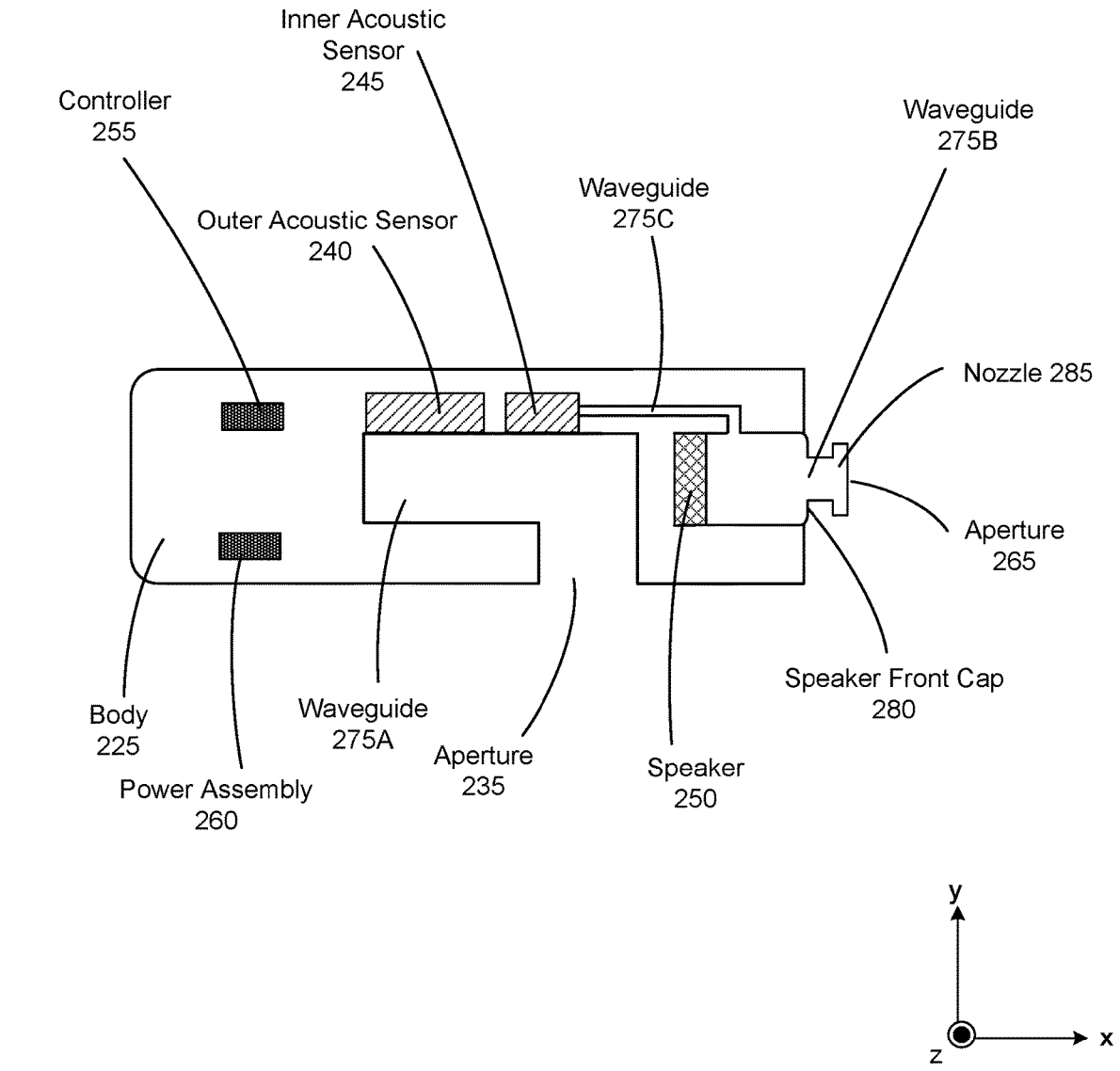
FIG. 2E is a cross-sectional side view of another embodiment of an ear-plug assembly with a speaker front cap and a nozzle, in accordance with one or more embodiments.

FIG. 2E is a cross-sectional side view 220 of another embodiment of an ear-plug assembly with a speaker front cap and a nozzle, in accordance with one or more embodiments. The ear-plug assembly in FIG. 2E is substantially similar to the ear-plug assembly shown in FIG. 2B, except that the ear-plug assembly in FIG. 2D includes the speaker front cap 280 and the nozzle 285. The speaker front cap 280 may be located a distance from the speaker 250, such as at least 0.6 mm. In some embodiments, the speaker front cap 280 may be located at a shorter distance from the speaker 250, such as in the range of 0.1 mm to 0.2 mm. A shorter distance of the speaker front cap 280 from the speaker 250 may result in improved quality of the sound presented to the user. The user may also perceive a wider frequency bandwidth of sound from the local area when the distance between the speaker front cap 280 and the speaker 250 is reduced.

In some embodiments, the ear-plug assembly shown in FIG. 2D includes the nozzle 285. The nozzle 285 may couple to the waveguide 275B. The nozzle 285 may be a cylinder with a diameter of 1.5 mm, at the end of which may be the aperture 265. The nozzle 285 may easily couple to a flexible cover (e.g., the flexible cover 130), allowing the ear-plug assembly to fit better and more comfortably into the user's ear canal.

Figure 3:
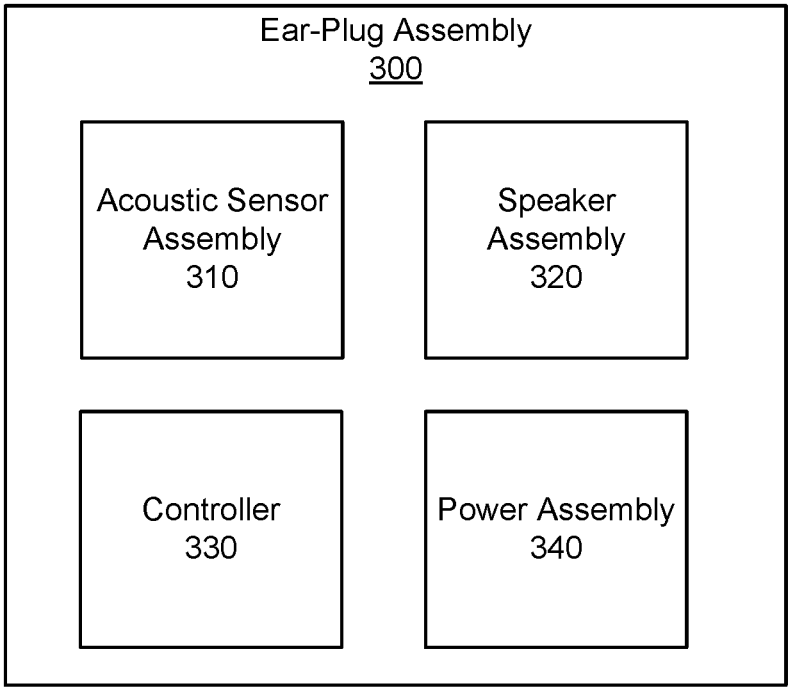
FIG. 3 is a block diagram of an ear-plug assembly, in accordance with one or more embodiments.

FIG. 3 is a block diagram of an ear-plug assembly 300, in accordance with one or more embodiments. The ear-plug assembly 300 may be a component of an audio system that provides audio content to a user (e.g., as discussed below with regard to FIG. 4). The ear-plug assembly 300 includes an acoustic sensor assembly 310, a speaker assembly 320, controller 330, and a power assembly 340. The ear-plug assemblies described in previous figures are embodiments of the ear-plug assembly 300. Some embodiments of the ear-plug assembly 300 include other components than those described herein.

The acoustic sensor assembly 310 detects sound. The acoustic sensor assembly 310 may include one or more acoustic sensors, which may be microphones, accelerometers, another sensor that detects acoustic pressure waves, or some combination thereof. An outer acoustic sensor of the acoustic sensor assembly 310, positioned in an unoccluded portion of the ear-plug assembly 300, may detect sound from a local area around the user. An inner acoustic sensor of the acoustic sensor assembly 310, positioned in a portion of the ear-plug assembly 300 that fits within an ear canal of the user, may detect sound presented to the user by tissue conduction. The acoustic sensors are configured to detect acoustic pressure waves and convert the detected pressure waves into an electric format (analog or digital).

The speaker assembly 320 presents audio content to the user in accordance with instructions from the controller 330. The speaker assembly 320 presents audio content to an ear canal of the user, based in part on sounds detected by the acoustic sensor assembly 310. The detected sound may be filtered, augmented, amplified, or attenuated when presented by the speaker assembly 320. The speaker assembly 320 may be composed of one or more speakers, such as the speaker 220 in FIGS. 2A-C, and present sound via airborne acoustic pressure waves. The speaker assembly 320 may be configured to present audio content over a range of frequencies, such as 20 Hz to 20 kHz, generally around the average range of human hearing.

The controller 330 processes the detected sound data and instructs the speaker assembly 320 to present audio content. The controller 330 may instruct the speaker assembly 320 to rebroadcast sound from the local area of the user, such that the user perceives a larger bandwidth of sound and spatial cues from the sound presented in a local area around them. The acoustic pressure wave data is detected by the acoustic sensor assembly 310 and subsequently sent to the controller 330. The controller 330 processes the sound data and instructs the speaker assembly 320 to present audio content. The controller 330's instructions for the speaker assembly 320 may include instructions to present filtered sound from the local area. For example, the controller 330 may generate sound filters that target a specific range of frequencies. ranges. The sound at these frequencies may be amplified, attenuated, or augmented, wherein the speaker assembly 520 presents audio content accordingly. Examples of sound filters include, among others, low pass filters, high pass filters, and bandpass filters. In some embodiments, certain frequency ranges may be amplified, preserving spatial cues and helping users with hearing loss in those frequency ranges better hear their environment. In other embodiments, the controller 330 may filter out noise generated by acoustic sensors in the acoustic sensor assembly 310. Since the acoustic sensors are small in size, the acoustic sensors are more likely to produce noise. In some embodiments, the user's voice may be amplified due to occlusion of the ear canal by the ear-plug assembly 300. The controller 330 may attenuate the amplitude of the user's voice, such that the user is able to hear the audio content presented by the speaker assembly 310.

The power assembly 340 provides the ear-plug assembly 300 with power. In some embodiments, there are one or more power units for some or all of the components of the ear-plug assembly 300. The power assembly 340 may provide power to, e.g., some or all of the components of the acoustic sensor assembly 310, the speaker assembly 320, and the data transfer assembly 330. A power unit is a battery. In some cases, a power unit is a rechargeable battery. In some embodiments, the power unit may be powered wirelessly (for example, inductively). In these embodiments, the power assembly 340 may include one or more receiving coils to receive power.

The ear-plug assembly 300 may be used to provide audio content to the user. In some embodiments, the ear-plug assembly 300 may work in conjunction with an artificial reality headset, such as those described by FIGS. 4A-4B. For example, the ear-plug assembly 300 may be used to calibrate an audio system of the artificial reality headset.

Figure 4A:
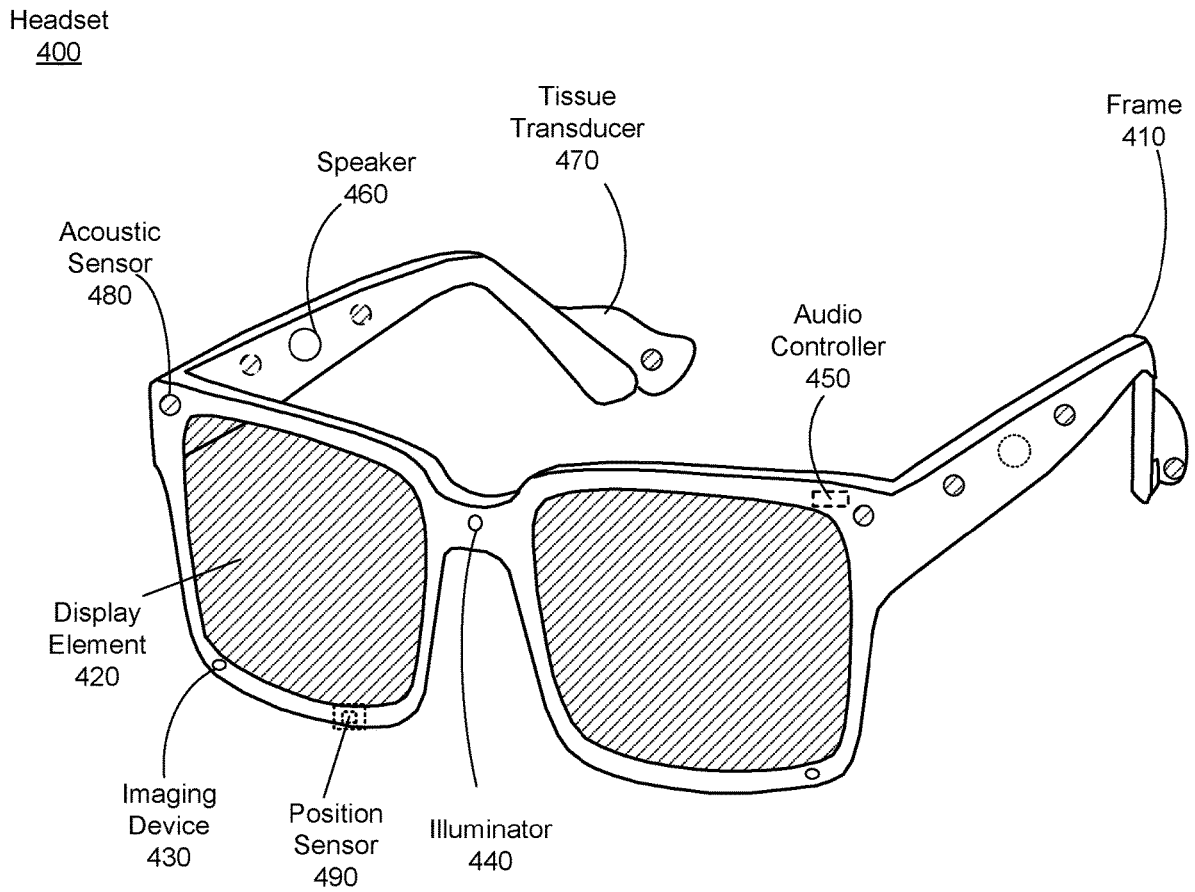
FIG. 4A is a perspective view of a headset implemented as an eyewear device, in accordance with one or more embodiments.

FIG. 4A is a perspective view of a headset 400 implemented as an eyewear device, in accordance with one or more embodiments. In some embodiments, the eyewear device is a near eye display (NED). In general, the headset 400 may be worn on the face of a user such that content (e.g., media content) is presented using a display assembly and/or an audio system. However, the headset 400 may also be used such that media content is presented to a user in a different manner. Examples of media content presented by the headset 400 include one or more images, video, audio, or some combination thereof. The headset 400 includes a frame, and may include, among other components, a display assembly including one or more display elements 420, a depth camera assembly (DCA), an audio system, and a position sensor 490. While FIG. 4A illustrates the components of the headset 400 in example locations on the headset 400, the components may be located elsewhere on the headset 400, on a peripheral device paired with the headset 400, or some combination thereof. Similarly, there may be more or fewer components on the headset 400 than what is shown in FIG. 4A. The frame 410 holds the other components of the headset 400. The frame 410 includes a front part that holds the one or more display elements 420 and end pieces (e.g., temples) to attach to a head of the user. The front part of the frame 410 bridges the top of a nose of the user. The length of the end pieces may be adjustable (e.g., adjustable temple length) to fit different users. The end pieces may also include a portion that curls behind the ear of the user (e.g., temple tip, ear piece).

The one or more display elements 420 provide light to a user wearing the headset 400. As illustrated the headset includes a display element 420 for each eye of a user. In some embodiments, a display element 420 generates image light that is provided to an eyebox of the headset 400. The eyebox is a location in space that an eye of user occupies while wearing the headset 400. For example, a display element 420 may be a waveguide display. A waveguide display includes a light source (e.g., a two-dimensional source, one or more line sources, one or more point sources, etc.) and one or more waveguides. Light from the light source is in-coupled into the one or more waveguides which outputs the light in a manner such that there is pupil replication in an eyebox of the headset 400. In-coupling and/or outcoupling of light from the one or more waveguides may be done using one or more diffraction gratings. In some embodiments, the waveguide display includes a scanning element (e.g., waveguide, mirror, etc.) that scans light from the light source as it is in-coupled into the one or more waveguides. Note that in some embodiments, one or both of the display elements 420 are opaque and do not transmit light from a local area around the headset 400. The local area is the area surrounding the headset 400. For example, the local area may be a room that a user wearing the headset 400 is inside, or the user wearing the headset 400 may be outside and the local area is an outside area. In this context, the headset 400 generates VR content. Alternatively, in some embodiments, one or both of the display elements 420 are at least partially transparent, such that light from the local area may be combined with light from the one or more display elements to produce AR and/or MR content. In some embodiments, a display element 420 does not generate image light, and instead is a lens that transmits light from the local area to the eyebox. For example, one or both of the display elements 420 may be a lens without correction (non-prescription) or a prescription lens (e.g., single vision, bifocal and trifocal, or progressive) to help correct for defects in a user's eyesight. In some embodiments, the display element 420 may be polarized and/or tinted to protect the user's eyes from the sun.

Note that in some embodiments, the display element 420 may include an additional optics block (not shown). The optics block may include one or more optical elements (e.g., lens, Fresnel lens, etc.) that direct light from the display element 420 to the eyebox. The optics block may, e.g., correct for aberrations in some or all of the image content, magnify some or all of the image, or some combination thereof.

The DCA determines depth information for a portion of a local area surrounding the headset 400. The DCA includes one or more imaging devices 430 and a DCA controller (not shown in FIG. 4A), and may also include an illuminator 440. In some embodiments, the illuminator 440 illuminates a portion of the local area with light. The light may be, e.g., structured light (e.g., dot pattern, bars, etc.) in the infrared (IR), IR flash for time-of-flight, etc. In some embodiments, the one or more imaging devices 430 capture images of the portion of the local area that include the light from the illuminator 440. As illustrated, FIG. 4A shows a single illuminator 440 and two imaging devices 430. In alternate embodiments, there is no illuminator 440 and at least two imaging devices 430.

The DCA controller computes depth information for the portion of the local area using the captured images and one or more depth determination techniques. The depth determination technique may be, e.g., direct time-of-flight (ToF) depth sensing, indirect ToF depth sensing, structured light, passive stereo analysis, active stereo analysis (uses texture added to the scene by light from the illuminator 440), some other technique to determine depth of a scene, or some combination thereof.

The audio system provides audio content. The audio system includes a transducer array, a sensor array, and an audio controller 450. However, in other embodiments, the audio system may include different and/or additional components. Similarly, in some cases, functionality described with reference to the components of the audio system can be distributed among the components in a different manner than is described here. For example, some or all of the functions of the controller may be performed by a remote server.

The transducer array presents sound to user. The transducer array includes a plurality of transducers. A transducer may be a speaker 460 or a tissue transducer 470 (e.g., a bone conduction transducer or a cartilage conduction transducer).

Although the speakers 460 are shown exterior to the frame 410, the speakers 460 may be enclosed in the frame 410. In some embodiments, instead of individual speakers for each ear, the headset 400 includes a speaker array comprising multiple speakers integrated into the frame 410 to improve directionality of presented audio content. The tissue transducer 470 couples to the head of the user and directly vibrates tissue (e.g., bone or cartilage) of the user to generate sound. The number and/or locations of transducers may be different from what is shown in FIG. 4A.

The sensor array detects sounds within the local area of the headset 400. The sensor array includes a plurality of acoustic sensors 480. An acoustic sensor 480 captures sounds emitted from one or more sound sources in the local area (e.g., a room). Each acoustic sensor is configured to detect sound and convert the detected sound into an electronic format (analog or digital). The acoustic sensors 480 may be acoustic wave sensors, microphones, sound transducers, or similar sensors that are suitable for detecting sounds.

In some embodiments, one or more acoustic sensors 480 may be placed in an ear canal of each ear (e.g., acting as binaural microphones). In some embodiments, the acoustic sensors 480 may be placed on an exterior surface of the headset 400, placed on an interior surface of the headset 400, separate from the headset 400 (e.g., part of some other device), or some combination thereof. The number and/or locations of acoustic sensors 480 may be different from what is shown in FIG. 4A. For example, the number of acoustic detection locations may be increased to increase the amount of audio information collected and the sensitivity and/or accuracy of the information. The acoustic detection locations may be oriented such that the microphone is able to detect sounds in a wide range of directions surrounding the user wearing the headset 400.

The audio controller 450 processes information from the sensor array that describes sounds detected by the sensor array. The audio controller 450 may comprise a processor and a computer-readable storage medium. The audio controller 450 may be configured to generate direction of arrival (DOA) estimates, generate acoustic transfer functions (e.g., array transfer functions and/or head-related transfer functions), track the location of sound sources, form beams in the direction of sound sources, classify sound sources, generate sound filters for the speakers 460, or some combination thereof.

The position sensor 490 generates one or more measurement signals in response to motion of the headset 400. The position sensor 490 may be located on a portion of the frame 410 of the headset 400. The position sensor 490 may include an inertial measurement unit (IMU). Examples of position sensor 490 include: one or more accelerometers, one or more gyroscopes, one or more magnetometers, another suitable type of sensor that detects motion, a type of sensor used for error correction of the IMU, or some combination thereof. The position sensor 490 may be located external to the IMU, internal to the IMU, or some combination thereof.

In some embodiments, the headset 400 may provide for simultaneous localization and mapping (SLAM) for a position of the headset 400 and updating of a model of the local area. For example, the headset 400 may include a passive camera assembly (PCA) that generates color image data. The PCA may include one or more RGB cameras that capture images of some or all of the local area. In some embodiments, some or all of the imaging devices 430 of the DCA may also function as the PCA. The images captured by the PCA and the depth information determined by the DCA may be used to determine parameters of the local area, generate a model of the local area, update a model of the local area, or some combination thereof. Furthermore, the position sensor 490 tracks the position (e.g., location and pose) of the headset 400 within the room.

Figure 4B:
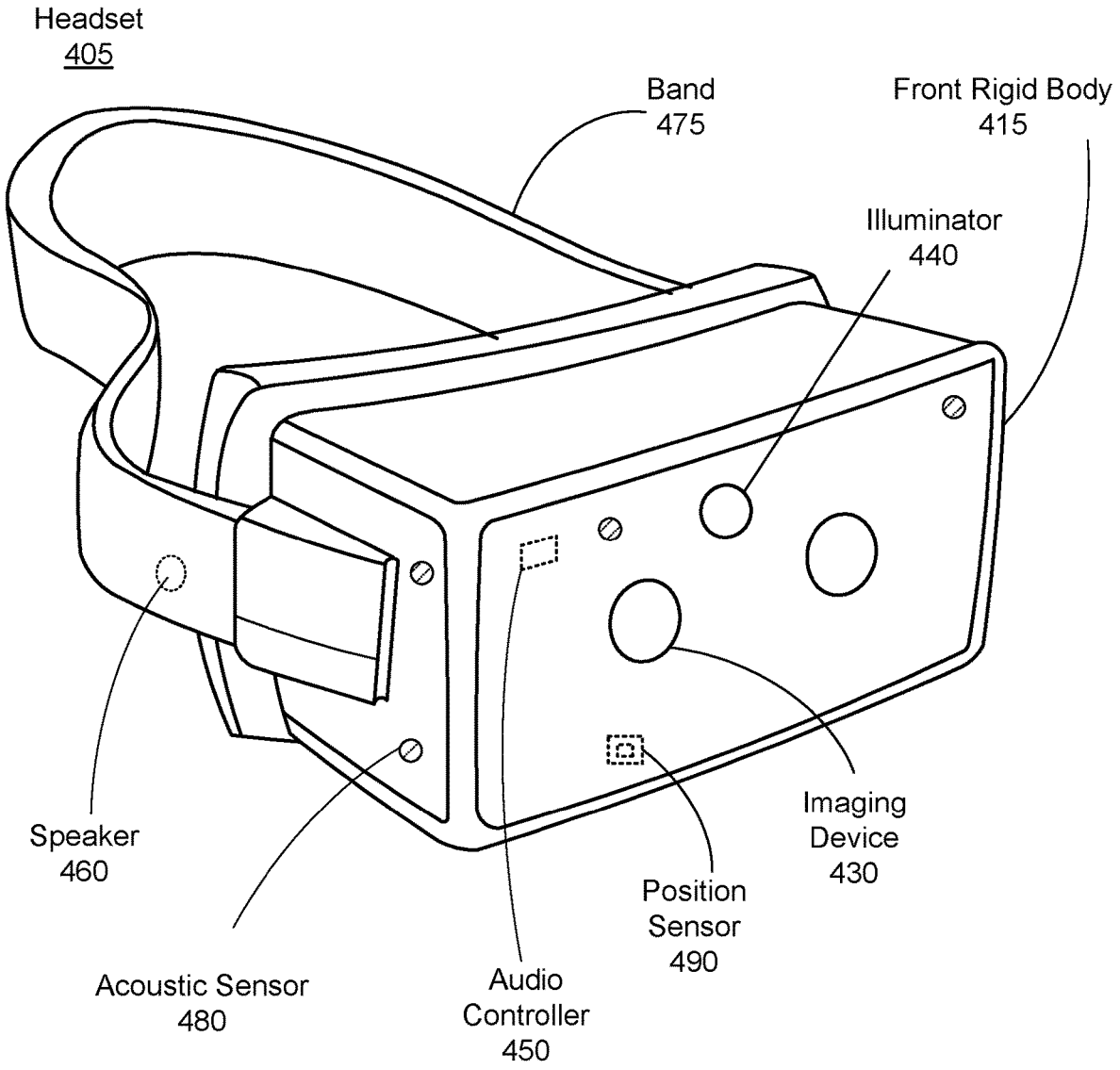
FIG. 4B is a perspective view of a headset implemented as a head-mounted display, in accordance with one or more embodiments.

FIG. 4B is a perspective view of a headset 405 implemented as a HMD, in accordance with one or more embodiments. In embodiments that describe an AR system and/or a MR system, portions of a front side of the HMD are at least partially transparent in the visible band (~380 nm to 750 nm), and portions of the HMD that are between the front side of the HMD and an eye of the user are at least partially transparent (e.g., a partially transparent electronic display). The HMD includes a front rigid body 415 and a band 475. The headset 405 includes many of the same components described above with reference to FIG. 4A, but modified to integrate with the HMD form factor. For example, the HMD includes a display assembly, a DCA, an audio system, and a position sensor 490. FIG. 4B shows the illuminator 440, a plurality of the speakers 460, a plurality of the imaging devices 430, a plurality of acoustic sensors 480, and the position sensor 490.

A hear-through ear-plug assembly, such as the ear-plug assembly 300, may work in conjunction with the headset 400 and/or the headset 405. In some embodiments, some components of the headset 400 and/or the headset 405 may double as components of the ear-plug assembly 300. For example, the audio controller 450 may serve as the controller 330 of the ear-plug assembly 300. In some embodiments, the user may wear the headset 400 and/or the headset 405 in addition to the ear-plug assembly 300. In another embodiment, the headset 400 and/or 405 may present visual content to the user, via the display element 420, that corresponds to rebroadcast audio content presented by the ear-plug assembly 300.

Example of an Artificial Reality System

Figure 5:
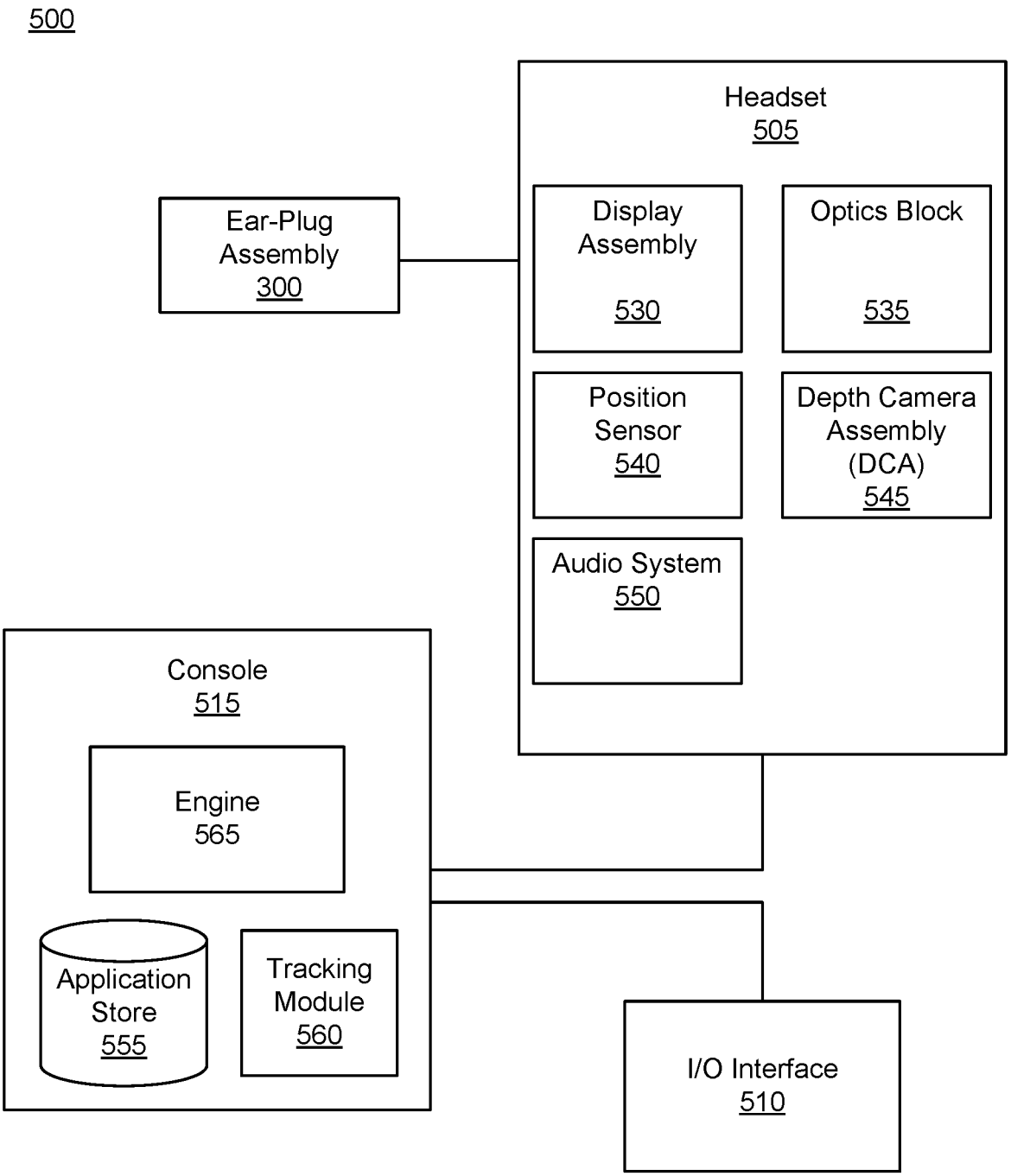
FIG. 5 is a block diagram of an example artificial reality system environment, including an ear-plug assembly, in accordance with one or more embodiments.

FIG. 5 is a system 500 that includes a headset 505, in accordance with one or more embodiments. In some embodiments, the headset 505 may be the headset 400 of FIG. 4A or the headset 405 of FIG. 4B. The system 500 may operate in an artificial reality environment (e.g., a virtual reality environment, an augmented reality environment, a mixed reality environment, or some combination thereof). The system 500 shown by FIG. 5 includes the headset 505, an input/output (I/O) interface 510 that is coupled to a console 515, the network 520, and the mapping server 525. While FIG. 5 shows an example system 500 including one headset 505 and one I/O interface 510, in other embodiments any number of these components may be included in the system 500. For example, there may be multiple headsets each having an associated I/O interface 510, with each headset and I/O interface 510 communicating with the console 515. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 515 may be provided by the headset 505.

The headset 505 includes the display assembly 530, an optics block 535, one or more position sensors 540, and the DCA 545. Some embodiments of headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The display assembly 530 displays content to the user in accordance with data received from the console 515. The display assembly 530 displays the content using one or more display elements (e.g., the display elements 120). A display element may be, e.g., an electronic display. In various embodiments, the display assembly 530 comprises a single display element or multiple display elements (e.g., a display for each eye of a user). Examples of an electronic display include: a liquid crystal display (LCD), an organic light emitting diode (OLED) display, an active-matrix organic light-emitting diode display (AMOLED), a waveguide display, some other display, or some combination thereof. Note in some embodiments, the display element 120 may also include some or all of the functionality of the optics block 535.

The optics block 535 may magnify image light received from the electronic display, corrects optical errors associated with the image light, and presents the corrected image light to one or both eyeboxes of the headset 505. In various embodiments, the optics block 535 includes one or more optical elements. Example optical elements included in the optics block 535 include: an aperture, a Fresnel lens, a convex lens, a concave lens, a filter, a reflecting surface, or any other suitable optical element that affects image light. Moreover, the optics block 535 may include combinations of different optical elements. In some embodiments, one or more of the optical elements in the optics block 535 may have one or more coatings, such as partially reflective or anti-reflective coatings.

Magnification and focusing of the image light by the optics block 535 allows the electronic display to be physically smaller, weigh less, and consume less power than larger displays. Additionally, magnification may increase the field of view of the content presented by the electronic display. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

In some embodiments, the optics block 535 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display for display is pre-distorted, and the optics block 535 corrects the distortion when it receives image light from the electronic display generated based on the content.

The position sensor 540 is an electronic device that generates data indicating a position of the headset 505. The position sensor 540 generates one or more measurement signals in response to motion of the headset 505. The position sensor 190 is an embodiment of the position sensor 540. Examples of a position sensor 540 include: one or more IMUS, one or more accelerometers, one or more gyroscopes, one or more magnetometers, another suitable type of sensor that detects motion, or some combination thereof. The position sensor 540 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the headset 505 from the sampled data. For example, the IMU integrates the measurement signals received from the accelerometers over time to estimate a velocity vector and integrates the velocity vector over time to determine an estimated position of a reference point on the headset 505. The reference point is a point that may be used to describe the position of the headset 505. While the reference point may generally be defined as a point in space, however, in practice the reference point is defined as a point within the headset 505.

The DCA 545 generates depth information for a portion of the local area. The DCA includes one or more imaging devices and a DCA controller. The DCA 545 may also include an illuminator. Operation and structure of the DCA 545 is described above with regard to FIG. 1A.

The audio system 550 provides audio content to a user of the headset 505. The audio system 550 is substantially the same as the audio system 200 describe above. The audio system 550 may comprise one or acoustic sensors, one or more transducers, and an audio controller. The audio system 550 may provide spatialized audio content to the user. In some embodiments, the audio system 550 may request acoustic parameters from the mapping server 525 over the network 520. The acoustic parameters describe one or more acoustic properties (e.g., room impulse response, a reverberation time, a reverberation level, etc.) of the local area. The audio system 550 may provide information describing at least a portion of the local area from e.g., the DCA 545 and/or location information for the headset 505 from the position sensor 540. The audio system 550 may generate one or more sound filters using one or more of the acoustic parameters received from the mapping server 525, and use the sound filters to provide audio content to the user.

The audio system 550 also presents audio content to the user of the headset 505. In some embodiments, the ear-plug assembly 300 may be a component of the audio system 550. In some embodiments, the audio system 550 may use the ear-plug assembly 300 for calibration. For example, the audio system 550 may present to the user audio content, based on sounds in the local area around the user, that preserves spatial cues as per the ear-plug assembly 300's filtering of sounds from the local area. The audio system 550 may present to the user audio content via air conduction and/or tissue conduction. In tissue conduction, the tissue in and/or around the user's ear is vibrated to produce acoustic pressure waves perceived by a cochlea of the user's ear as sound.

The I/O interface 510 is a device that allows a user to send action requests and receive responses from the console 515. An action request is a request to perform a particular action. For example, an action request may be an instruction to start or end capture of image or video data, or an instruction to perform a particular action within an application. The I/O interface 510 may include one or more input devices. Example input devices include: a keyboard, a mouse, a game controller, or any other suitable device for receiving action requests and communicating the action requests to the console 515. An action request received by the I/O interface 510 is communicated to the console 515, which performs an action corresponding to the action request. In some embodiments, the I/O interface 510 includes an IMU that captures calibration data indicating an estimated position of the I/O interface 510 relative to an initial position of the I/O interface 510. In some embodiments, the I/O interface 510 may provide haptic feedback to the user in accordance with instructions received from the console 515. For example, haptic feedback is provided when an action request is received, or the console 515 communicates instructions to the I/O interface 510 causing the I/O interface 510 to generate haptic feedback when the console 515 performs an action.

The console 515 provides content to the headset 505 for processing in accordance with information received from one or more of: the DCA 545, the headset 505, and the I/O interface 510. In the example shown in FIG. 5, the console 515 includes an application store 555, a tracking module 560, and an engine 565. Some embodiments of the console 515 have different modules or components than those described in conjunction with FIG. 5. Similarly, the functions further described below may be distributed among components of the console 515 in a different manner than described in conjunction with FIG. 5. In some embodiments, the functionality discussed herein with respect to the console 515 may be implemented in the headset 505, or a remote system.

The application store 555 stores one or more applications for execution by the console 515. An application is a group of instructions, that when executed by a processor, generates content for presentation to the user. Content generated by an application may be in response to inputs received from the user via movement of the headset 505 or the I/O interface 510. Examples of applications include: gaming applications, conferencing applications, video playback applications, or other suitable applications.

The tracking module 560 tracks movements of the headset 505 or of the I/O interface 510 using information from the DCA 545, the one or more position sensors 540, or some combination thereof. For example, the tracking module 560 determines a position of a reference point of the headset 505 in a mapping of a local area based on information from the headset 505. The tracking module 560 may also determine positions of an object or virtual object. Additionally, in some embodiments, the tracking module 560 may use portions of data indicating a position of the headset 505 from the position sensor 540 as well as representations of the local area from the DCA 545 to predict a future location of the headset 505. The tracking module 560 provides the estimated or predicted future position of the headset 505 or the I/O interface 510 to the engine 565.

The engine 565 executes applications and receives position information, acceleration information, velocity information, predicted future positions, or some combination thereof, of the headset 505 from the tracking module 560. Based on the received information, the engine 565 determines content to provide to the headset 505 for presentation to the user. For example, if the received information indicates that the user has looked to the left, the engine 565 generates content for the headset 505 that mirrors the user's movement in a virtual local area or in a local area augmenting the local area with additional content. Additionally, the engine 565 performs an action within an application executing on the console 515 in response to an action request received from the I/O interface 510 and provides feedback to the user that the action was performed. The provided feedback may be visual or audible feedback via the headset 505 or haptic feedback via the I/O interface 510.

The ear-plug assembly 300 provides audio content to the user. The ear-plug assembly 300, as described with respect to FIGS. 1-3, detects sound from the local area via the acoustic sensor assembly 310, processes the sound data via the controller 330, and presents audio content based in part on the detected sound via the speaker assembly 320. The ear-plug assembly 300 is powered by the power assembly 340. The ear-plug assembly 300 may be used alone and/or in combination with the audio system 550, providing audio content to the user of the headset based in part on the sounds from the local area detected by the ear-plug assembly 300. In some embodiments, the user may use two ear-plug assemblies 300, i.e., one for each ear. Each ear-plug assembly 300 may provide a portion of the audio content as instructed by the controller 330.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like, in relation to manufacturing processes. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described (e.g., in relation to manufacturing processes.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An ear-plug assembly comprising:

an acoustic sensor configured to detect sounds from a local area surrounding a user;

a body configured to have an aperture positioned between the acoustic sensor and an entrance of an ear canal of the user, wherein the acoustic sensor detects sound from the local area via the aperture; and a speaker configured to present audio content within the ear canal based in part on the sounds detected from the local area.

2. The ear-plug assembly of claim 1, wherein the body is partially enclosed within a flexible cover that fits to a shape of the ear canal and seals against the ear canal.

3. The ear-plug assembly of claim 1, wherein a portion of the body that is coupled to the speaker is configured to be within the ear canal.

4. The ear-plug assembly of claim 1, wherein the first aperture includes a first side and a second side and an angle between the first side and the second side measured relative to a central axis of the body is at least 280 degrees.

5. The ear-plug assembly of claim 1, wherein the body further comprises an additional aperture, the additional aperture being an additional entrance to a first acoustic waveguide.

6. The ear-plug assembly of claim 1, further comprising an additional acoustic sensor that receives sound from the local area, the additional acoustic sensor positioned on a surface of the body.

7. The ear-plug assembly of claim 1, further comprising an additional acoustic sensor located within a region of the body configured to fit within the ear canal.

8. The ear-plug assembly of claim 7, wherein the additional acoustic sensor is located adjacent to a second aperture located in the region of the body configured to fit within the ear canal.

9. The ear-plug assembly of claim 8, wherein the second aperture is an entrance to an acoustic waveguide that guides sound to the additional acoustic sensor.

10. The ear-plug assembly of claim 1, wherein the body is comprised of a first portion and a second portion, and the first portion is configured to at least partially fit inside the ear canal of the user and the second portion is configured to be located outside of the ear canal, the ear-plug assembly further comprising:

an additional acoustic sensor located within the second portion of the body; and an acoustic waveguide located within both the first portion and second portion of the body, wherein sound within the ear canal propagates to the additional acoustic sensor through the acoustic waveguide.

11. The ear-plug assembly of claim 1, wherein the speaker is positioned on a surface of the body.

12. The ear-plug assembly of claim 1, further comprising a waveguide that couples the speaker to a second aperture on the surface of the body, wherein the sound from the speaker propagates through the waveguide and exits the second aperture into the ear canal.

13. The ear-plug assembly of claim 12, wherein the second aperture is located in a portion of the body configured to fit within the ear canal.

14. The ear-plug assembly of claim 1, further comprising a controller configured to control what audio content is presented by the speaker.

15. A method comprising:

detecting sounds from a local area surrounding a user via an acoustic sensor of an ear plug assembly, the ear plug assembly including a body including a speaker and an aperture, the aperture positioned between the acoustic sensor and an entrance of an ear canal of the user, wherein the acoustic sensor detects sound from the local area via the aperture;

generating sound filters using the sounds detected from the local area; and presenting, via the speaker, adjusted audio content based in part on the sound filters to the ear canal.

16. The method of claim 15, wherein the body is partially enclosed within a flexible cover that fits to a shape of the ear canal and seals against the ear canal.

17. The method of claim 15, wherein the first aperture includes a first side and a second side and an angle between the first side and the second side measured relative to a central axis of the body is at least 280 degrees.

18. The method of claim 15, wherein the body further comprises a second aperture, the second aperture being an entrance to an acoustic waveguide and located in a region of the body configured to fit within the ear canal.

19. The method of claim 18, wherein sound from the speaker propagates through the acoustic waveguide to exit through the second aperture, the sound presented to an inner ear of the user.

20. A non-transitory computer readable medium configured to store program code instructions, that when executed by a processor, cause an ear plug assembly to perform steps comprising:

detecting sounds from a local area surrounding a user via an acoustic sensor of the ear plug assembly, the ear plug assembly including a body including a speaker and an aperture, the aperture positioned between the acoustic sensor and an entrance of an ear canal of the user, wherein the acoustic sensor detects sound from the local area via the aperture;

generating sound filters using the sounds detected from the local area; and presenting, via the speaker, adjusted audio content based in part on the sound filters to the ear canal.

* * * * *